United States Patent [19]

Sung et al.

[11] Patent Number: 4,852,993

[45] Date of Patent: Aug. 1, 1989

[54] ORI-INHIBITED AND DEPOSIT-RESISTANT MOTOR FUEL COMPOSITION

[75] Inventors: Rodney L. Sung, Fishkill; Thomas Hayden, Wappingers Falls; Michael A. Caggiano, Chelsea; Milton D. Behrens, Fishkill, all of N.Y.

[73] Assignee: Texaco Inc., White Plains, N.Y.

[21] Appl. No.: 84,354

[22] Filed: Aug. 12, 1987

[51] Int. Cl.[4] ..... C10L 1/14

[52] U.S. Cl. ..... 44/62; 44/63; 44/71; 44/72

[58] Field of Search ..... 44/62, 63, 71, 72; 562/564

[56] References Cited

U.S. PATENT DOCUMENTS

| | | | |
|---|---|---|---|
| 3,438,757 | 4/1969 | Honnen | 44/72 |
| 4,357,148 | 11/1982 | Graiff | 44/72 |
| 4,526,587 | 7/1985 | Campbell | 44/72 |
| 4,581,040 | 4/1986 | Sung et al. | 44/71 |
| 4,604,103 | 8/1986 | Campbell | 44/72 |
| 4,631,069 | 12/1986 | Sung | 44/71 |
| 4,643,737 | 2/1987 | Sung et al. | 44/63 |
| 4,643,738 | 2/1987 | Sung et al. | 44/71 |
| 4,659,336 | 4/1987 | Sung et al. | 44/62 |
| 4,659,337 | 4/1987 | Sung | 44/63 |
| 4,689,051 | 8/1987 | Sung | 44/63 |

*Primary Examiner*—William R. Dixon, Jr.
*Assistant Examiner*—Margaret B. Medley
*Attorney, Agent, or Firm*—Robert A. Kulason; James J. O'Loughlin; Louis S. Sorell

[57] ABSTRACT

ORI-inhibited and deposit-resistant motor fuel composition comprises a mixture of hydrocarbons boiling in the range of 90° F.–450° F. and (I) the reaction product of a dibasic acid anhydride, a polyoxyalkylene diamine, and a hydrocarbyl polyamine; and (II) a mixture comprising polyisobutylene ethylene diamine and polyisobutylene in a hydrocarbon solvent. Motor fuel compositions of the instant invention show improved ORI control and valve deposit control in comparison with typical commercial fuel compositions.

11 Claims, 2 Drawing Sheets

ENGINE OCTANE REQUIREMENT VS. ENGINE OPERATION (HOURS) – FRDT

ENGINE OCTANE REQUIREMENT VS. ENGINE OPERATION (HOURS) – CHEVY TEST

ORI-INHIBITED AND DEPOSIT-RESISTANT MOTOR FUEL COMPOSITION

BACKGROUND OF THE INVENTION

1. Field of the Invention

This invention relates to a deposit-resistant and ORI-inhibited motor fuel composition, and to a concentrate formulation for use in motor fuel compositions. More particularly, this invention relates to a deposit-resistant and ORI-inhibited motor fuel composition comprising: (I) the reaction product of a dibasic acid anhydride, a polyoxyalkylene diamine, and a hydrocarbyl polyamine; and (II) a mixture of a major amount of polyisobutylene ethylene diamine and a minor amount of polyisobutylene. Concentrates of the instant invention comprise components (I) and (II) in admixture with a hydrocarbon solvent to facilitate introduction of the concentrate into a motor fuel composition.

Combustion of a hydrocarbon motor fuel in an internal combustion engine generally results in the formation and accumulation of deposits on various parts of the combustion chamber as well as on the fuel intake and exhaust systems of the engine. The presence of deposits in the combustion chamber seriously reduces the operating efficiency of the engine. First, deposit accumulation within the combustion chamber inhibits heat transfer between the chamber and the engine cooling system. This leads to higher temperatures within the combustion chamber, resulting in increases in the end gas temperature of the incoming charge. Consequently, end gas auto-ignition occurs, which causes engine knock. In addition, the accumulation of deposits within the combustion chamber reduces the volume of the combustion zone, causing a higher than design compression ratio in the engine. This, in turn, also results in serious engine knocking. A knocking engine does not effectively utilize the energy of combustion. Moreover, a prolonged period of engine knocking will cause stress fatigue and wear in vital parts of the engine. The above-described phenomenon is characteristic of gasoline powered internal combustion engines. It is usually overcome by employing a higher octane gasoline for powering the engine, and hence has become known as the engine octane requirement increase (ORI) phenomenon. It would therefore be highly advantageous if engine ORI could be substantially reduced or eliminated by preventing or modifying deposit formation in the combustion chambers of the engine.

Another problem common to internal combustion engines relates to the accumulation of deposits in the carburetor which tend to restrict the flow of air through the carburetor at idle and at low speed, resulting in an overrich fuel mixture. This condition also promotes incomplete fuel combustion and leads to rough engine idling and engine stalling. Excessive hydrocarbon and carbon monoxide exhaust emissions are also produced under these conditions. It would therefore be desirable from the standpoint of engine operability and overall air quality to provide a motor fuel composition which minimizes or overcomes the above-described problems.

A third problem common to internal combustion engines is the formation of intake valve deposits. Intake valve deposits interfere with valve closing and eventually result in valve burning. Such deposits interfere with valve motion and valve sealing, and in addition reduce volumetric efficiency of the engine and limit maximum power. Valve deposits are usually a result of thermal and oxidative unstable fuel or lubricating oil oxidation products. Hard carbonaceous deposits collect in the tubes and runners that conduct the exhaust gas recirculation (EGR) gases. These deposits are believed to be formed from exhaust particles which are subjected to rapid cooling while mixing with the air-fuel mixture. Reduced EGR flow can result in engine knock and $NO_x$ emission increases. It would therefore be desirable to provide a motor fuel composition which minimizes or overcomes the formation of intake valve deposits.

It is the object of this invention to provide a deposit-resistant and ORI-inhibited motor fuel composition, as well as a hydrocarbon solvent-based concentrate composition which may be added to motor fuel to produce such a motor fuel composition. Motor fuel compositions of the instant invention exhibit both reduced ORI and increased resistance to carburetor intake valve, intake manifold, and EGR system deposit formation in comparison with conventional motor fuel compositions.

2. Information Disclosure Statement

Co-assigned U.S. Pat. appl. Ser. No. 000,253, filed Jan. 2, 1987 (Sung et al.) (D#78,650) discloses a novel polyoxyalkylene diamine compound of the formula:

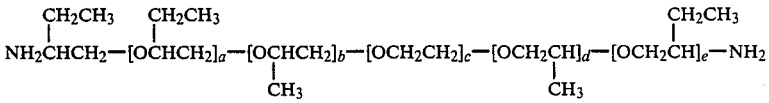

where c has a value from about 5–150, b+d has a value from about 5–150, and a+e has a value from about 2–12. Motor fuel compositions comprising the novel polyoxyalkylene diamine, alone or in combination with a polymer/copolymer additive are also disclosed.

Co-assigned U.S. Pat. appl. Ser. No. 000,230, filed Jan. 2, 1987 (Sung et al.) (D#78,679) discloses a motor fuel composition comprising the reaction product of the polyoxyalkylene diamine of U.S. Pat. appl. Ser. No. 000,253, a dibasic acid anhydride, and a hydrocarbyl polyamine. An optional additional polymer/copolymer additive with a molecular weight of 500–3500 may also be employed in conjunction with the reaction product additive.

Co-assigned U.S. Pat. No. 4,659,337 (Sung et al.) discloses the use of the reaction product of maleic anhydride, a polyether polyamine containing oxyethylene and oxypropylene ether moieties, and a hydrocarbyl polyamine in a gasoline motor fuel to reduce engine ORI and provide carburetor detergency.

Co-assigned U.S. Pat. No. 4,659,336 (Sung et al.) discloses the use of the mixture of: (i) the reaction product of maleic anhydride, a polyether polyamine containing oxyethylene and oxypropylene ether moieties, and a hydrocarbyl polyamine; and (ii) a polyolefin polymer/copolymer as an additive in motor fuel compositions to reduce engine ORI.

Co-assigned U.S. Pat. No. 4,631,069 (Sung) discloses an alcohol-containing motor fuel composition which additionally comprises an anti-wear additive which is the reaction product of a dibasic acid anhydride, a polyoxyisopropylene diamine of the formula $$NH_2-\underset{\underset{CH_3}{|}}{CH}-CH_2-(OCH_2-\underset{\underset{CH_3}{|}}{CH})_x-NH_2$$

where x has a value of 2–68, and an n-alkyl-alkylene diamine.

Co-assigned U.S. Pat. No. 4,643,738 (Sung et al.) discloses a motor fuel composition comprising a deposit-control additive which is the reaction product of a dibasic acid anhydride, a polyoxyisopropylene diamine of the formula $$NH_2-\underset{\underset{CH_3}{|}}{CH}-CH_2-(OCH_2-\underset{\underset{CH_3}{|}}{CH})_x-NH_2$$

where x has a value of 2–50, and an n-alkyl-alkylene diamine.

U.S. Pat. No. 4,604,103 (Campbell) discloses a motor fuel deposit control additive for use in internal combustion engines which maintains cleanliness of the engine intake system without contributing to combustion chamber deposits or engine octane requirement increase (ORI). The additive disclosed is a hydrocarbyl polyoxyalkylene polyamine ethane of molecular weight range 300–2500 having the formula $$R-(OCH_2\underset{\underset{R'}{|}}{CH})_x-OCH_2-CH_2-NR''R'''$$

where R is a hydrocarbyl radical of from 1 to about 30 carbon atoms; R' is selected from methyl and ethyl; x is an integer from 5 to 30; and R'' and R''' are independently selected from hydrogen and U.S. Pat. No. 4,166,726 (Harle) discloses a fuel additive which is the combination of (i) the reaction product of an alkylphenol, an aldehyde, and an amine, and (ii) a polyalkylene amine.

U.S. Pat. No. 3,960,515 (Honnen) and U.S. Pat. No. 3,898,056 (Honnen) disclose the use of a mixture of high and low molecular weight hydrocarbyl amines as a detergent and dispersant in motor fuel compositions.

U.S. Pat. No. 3,438,757 (Honnen et al.) discloses the use of hydrocarbyl amines and polyamines with a molecular weight range of 450–10,000, alone or in combination with a lubricating mineral oil, as a detergent for motor fuel compositions.

SUMMARY OF THE INVENTION

Motor fuel compositions of the instant invention show improved ORI-inhibition and carburetor and valve deposit resistance over conventional motor fuel compositions. Motor fuel compositions of the instant invention comprise a mixture of hydrocarbons boiling in the range 90° F.–450° F. and additionally comprise:

(I) from 0.0005–5.0 weight percent of the reaction product obtained by reacting a temperature of 30° C.–200° C.:

(a) about 1 mole of a dibasic acid anhydride of the formula

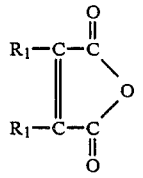

where $R_1$ is H or a $C_1$–$C_5$ alkyl radical, (b) 1–2 moles of a polyoxyalkylene diamine of the formula $$\underset{\underset{CH_2CH_3}{|}}{NH_2CHCH_2}-[O\underset{\underset{CH_2CH_3}{|}}{CHCH_2}]_a-[O\underset{\underset{CH_3}{|}}{CHCH_2}]_b-[OCH_2CH_2]_c-[OCH_2\underset{\underset{CH_3}{|}}{CH}]_d-[OCH_2\underset{\underset{CH_2CH_3}{|}}{CH}]_e-NH_2$$

where c has a value from about 5–150, b+d has a value from about 5–150, and a+e has a value from about 2–12, and (c) 1–2 moles of a hydrocarbyl polyamine which may be either (i) a hydrocarbyl polyamine of the formula $$R_2(NH-R_3)_x-NH_2$$

where $R_2$ is an alkyl radical having from about 1–24 carbon atoms, $R_3$ is an alkylene radical having from about 1–6 carbon atoms, and x has a value from about 1–10, or (ii) a n-alkyl-alkylene diamine of the formula $$R_4-NH-(CH_2)_n-NH_2$$

where $R_4$ is an aliphatic hydrocarbon radical having from about 1–24 carbon atoms and n had a value from about 1–6; and (II) from 0.001–1.0 weight percent of a mixture comprising a hydrocarbon solvent and:

$=(CH_2CH_2NH=)_y=H$ where y is an integer from 0–5.

Co-assigned U.S. Pat. No. 4,581,040 (Sung et al.) discloses the use of a reaction product as a deposit inhibitor additive in fuel compositions. The reaction product is a condensate product of the process comprising:

(i) reacting a dibasic acid anhydride with a polyoxyisopropylenediamine of the formula $$NH_2-\underset{\underset{CH_3}{|}}{CH}-CH_2-(OCH_2-\underset{\underset{CH_3}{|}}{CH})_x-NH_2$$

where x is a numeral of about 2–50, thereby forming a maleamic acid;

(ii) reacting said maleamic acid with a polyalkylene polyamine, thereby forming a condensate product; and (iii) recovering said condensate product.

U.S. Pat. No. 4,357,148 (Graiff) discloses a motor fuel additive useful in controlling ORI which is the combination of (a) an oil-soluble aliphatic polyamine containing at least one olefinic polymer chain, and (b) a polymer, copolymer, or corresponding hydrogenated polymer or copolymer of a $C_2$-$C_6$ mono olefin with a molecular weight of 50–1500.

(a) 50–75 parts by weight of polyisobutylene ethylene diamine of the formula

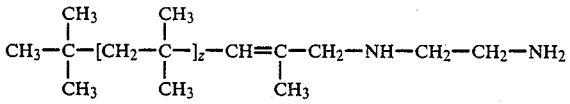

and (b) 5–25 parts by weight of polyisobutylene of the formula

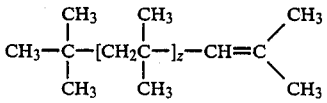

where z has a value of 30–40.

The instant invention is also directed to a concentrate comprising a hydrocarbon solvent in admixture with 0.1–10.0 weight percent of the abovedescribed reaction product component and 25.0–75.0 weight percent of the above-described hydrocarbon solvent-polyisobutylene ethylene diamine-polyisobutylene mixture.

BRIEF DESCRIPTION OF THE DRAWINGS

Referring now to the drawings.

DETAILED EMBODIMENTS OF THE INVENTION

Figure 1:
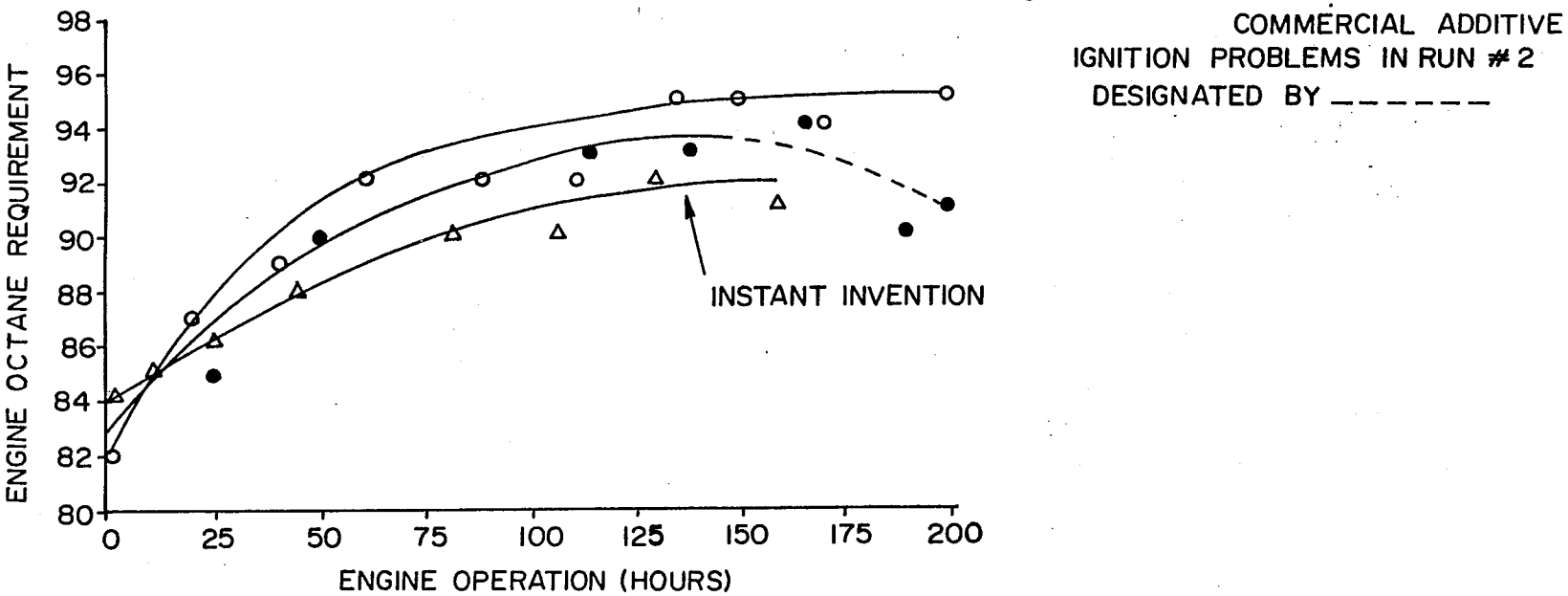
FIG. 1 is a graphical representation of data obtained which compares the octane requirement (as a function of hours of engine operation) of a Chevrolet 1.8 liter engine using an commercial unleaded base fuel containing 60 PTB of a commercial fuel additive, and the identical engine using a motor fuel composition of the instant invention as exemplified by Example IV.

Component (I) of the instant invention is a reaction product prepared by reacting a dibasic acid anhydride, a diamine containing block copolymers with polyoxyalkylene backbones, and a hydrocarbyl polyamine. The reaction product component of the instant invention is identical to the reaction product disclosed in co-assigned U.S. Pat. appl. Ser. No. 000,230 (D#78,679), incorporated herein by reference.

The dibasic acid anhydride reactant used to prepare the reaction product component of the instant invention is of the formula

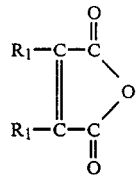

where $R_1$ is either H or a $C_1$—$C_5$ alkyl radical. Accordingly, dibasic acid anhydrides suitable for use include maleic anhydride; alpha-methyl maleic anhydride; alpha-ethyl maleic anhydride; and alpha, beta-dimethyl maleic anhydride. The preferred dibasic acid anhydride for use is maleic anhydride.

The polyoxyalkylene diamine reactant used to prepare the reaction product component of the instant invention is a diamine of the formula

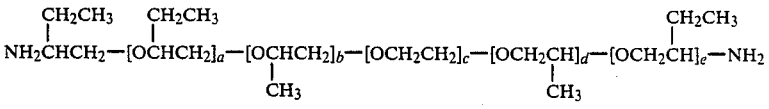

where c has a value from about 5–150, preferably 8–50; b +d has a value from about 5–150, preferably 8–50; and a +e has a value from about 2–12, preferably 4–8. The novelty of the prescribed polyoxyalkylene diamine reactant resides in the fact that it contains a large number (5–150, preferably 8–50) of polyoxypropylene and polyoxyethylene ether moieties in combination with a smaller number (2–12, preferably 4–8) of polyoxybutylene ether moieties. The method of synthesis of the prescribed novel polyoxyalkylene diamine reactant is set forth in detail in co-assigned U.S. Pat. appl. Ser. No. 000,253 (D#78,650), incorporated herein by reference.

The hydrocarbyl polyamine reactant used to prepare the reaction product component of the instant invention may be either:

(i) a hydrocarbyl polyamine of the formula $$R_2(NH—R_3)_x—NH_2$$

where $R_2$ is an alkyl radical having from about 1–24, preferably 12–20 carbon atoms, $R_3$ is an alkylene radical having from about 1–6 carbon atoms, and x has a value from 1–10, preferably 1–5; or (ii) a n-alkyl-alkylene diamine of the formula $$R_4—NH—(CH_2)_n—NH_2$$

where $R_4$ is an aliphatic hydrocarbon radical having from about 1 to 24 carbon atoms, preferably from about 12 to 20 carbon atoms, and n has a value from about 1 to 6, preferably having a value of 3. N-alkyl-alkylene diamines suitable for use in preparing the reaction product of the instant invention include aliphatic diamines commercially available from Akzo Chemie America Co. under the DUOMEEN series trade name. Examples of such n-alkyl-alkylene diamines include n-coco-1,3-diaminopropane (DUOMEEN C), n-soya-1,3-diaminopropane (DUOMEEN S), n-tallow-1,3-diaminopropane (DUOMEEN T), and n-oleyl-1,3-diaminopropane (DUOMEEN OL). The most preferred n-alkylalkylene diamine reactant for use in preparing the reaction product component of the instant invention is n-tallow-1,3 diaminopropane.

The reaction product component of the instant invention is prepared by first reacting about 1 mole of dibasic acid anhydride with about 1 to 2 moles, preferably 1.5 moles of the prescribed diamine reactant containing block copolymers with polyoxyethylene, polyoxypropylene and polyoxybutylene backbones at a temperature of 30° C.-200° C., preferably 90° C.-150° C. The reaction of dibasic acid anhydride with the polyoxyalkylene diamine reactant is preferably carried out in the presence of a solvent. A preferred solvent is one which will distill with water azetropically. Suitable solvents include hydrocarbons boiling in the gasoline boiling range of about 30° C. to about 200° C. Generally, this will include saturated and unsaturated hydrocarbons having from about 5 to about 10 carbon atoms. Specific suitable hydrocarbon solvents include hexane, cyclohexane, benzene, toluene, and mixtures thereof. Xylene is the preferred solvent. The solvent can be present in an amount of up to about 90% by weight of the total reaction mixture. The reaction mixture is thereafter cooled to 50° C.-75° C., preferably 60° C., and 1-2 moles, preferably 1 mole of the hydrocarbyl polyamine is added.

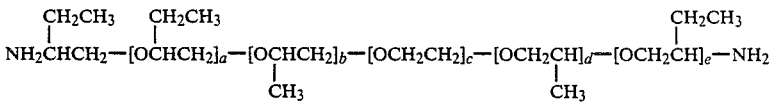

The new mixture is then reacted at 30° C.-200° C., preferably 90° C.-150° C.

In a preferred mode of preparing the reaction product component of the instant invention, about 1 mole of maleic anhydride and about 1.5 moles of the prescribed polyoxyalkylene diamine where c has a value of 8-50, b+d has a value of 8-50, and a+e has a value of 4-8 are combined with the solvent xylene and reacted at a temperature of about 100° C. The reaction mixture is maintained at this temperature for approximately 2 hours. The mixture is then cooled to about 60° C., whereupon about 1 mole of the hydrocarbyl polyamine n-tallow-1,3 diaminopropane is added. The new mixture is then reacted at about 140° C. for reflux and azeotroping for 5 hours, with about 1 to 1.5 moles of water being removed. The reaction product can then be separated from the solvent using conventional means, or left in admixture with some or all of the solvent.

A critical feature of the reaction product component of the instant invention is the presence of a large number (5-150, preferably 8-50) of polyoxypropylene and polyoxyethylene ether moieties in combination with more limited numbers (2-12, preferably 4-8) of polyoxybutylene ether moieties. These moieties are provided by the prescribed polyoxyalkylene diamine reactant. In particular, the presence of a large number of polyoxypropylene and polyoxyethylene ether moieties enhances the gasoline solubility of the reaction product component, thus increasing the efficacy of the reaction product as an additive in motor fuel compositions. The reaction product component of the instant invention is advantageous over other reaction product additives employed to control ORI in motor fuels such as those disclosed in co-assigned U.S. Pat. Nos. 4,659,336 and 4,659,337 in that the reaction product component of the instant invention is soluble in gasoline and similar motor fuel compositions, and therefore requires no admixing with a solvent prior to introduction into a base motor fuel composition.

The following examples illustrate the preferred method of preparing the novel reaction product component of the instant invention. It will be understood that the following examples are merely illustrative, and are not meant to limit the invention in any way. In the examples, all parts are parts by weight unless otherwise specified.

EXAMPLE I

In the best mode for preparing the reaction product component of the instant invention, 54 parts of maleic anhydride, 3265 parts of xylene, and 3000 parts of a polyoxyalkylene diamine were reacted at a temperature of 100° C. for 2 hours. The polyoxyalkylene diamine was of the formula where c had an approximate value of 5-150, b+d had an approximate value of 5-150, and a+e had an approximate value of 2-12.

The mixture was thereafter cooled to about 60° C., and 54 parts of n-tallow-1,3 diaminpropane (DUOMEEN T) were added. The new mixture was then reacted at about 140° C. for 5 hours to produce the final reaction product. The final reaction product was then filtered and stripped of remaining solvent under vacuum.

EXAMPLE II

A reaction product is formed by reacting 54 parts of maleic anhydride, 3206 parts of xylene, and 3000 parts of a polyoxyalkylene diamine at 100° C. for 2 hours. The polyoxyalkylene diamine is of the formula

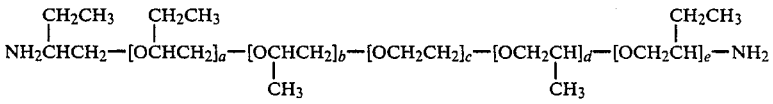

where c has an approximate value of 5-150, b+d has an approximate value of 5-150, and a+e has an approximate value of 2-12.

The mixture is thereafter cooled to about 60° C., and 152 parts of n-coco-1,2- diaminopropane (DUOMEEN C) are added. The new mixture is then reacted at about 140° C. for 5 hours to produce the final reaction product. The final reaction product is then filtered and stripped of remaining solvent under vacuum.

EXAMPLE III

A reaction product is formed by reacting 54 parts of maleic anhydride, 3231 parts of xylene, and 3000 parts of a polyoxyalkylene diamine at 100° C. for 2 hours. The polyoxyalkylene diamine is of the formula

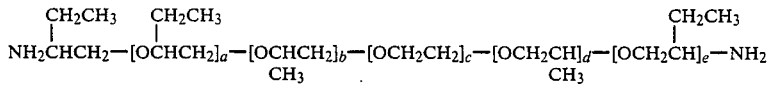

where c has an approximate value of 5–150, b+d has an approximate value of 5–150, and a+e has an approximate value of 2–12.

The mixture is thereafter cooled to about 60° C., and 176 parts of n-oleyl-1,3 diaminopropane (DUOMEEN OL) are added. The new mixture is then reacted at about 140° C. for 5 hours to produce the final reaction product. The final reaction product is then filtered and stripped of remaining solvent under vacuum.

Component (II) of the motor fuel composition of the instant invention is a mixture of a major amount of polyisobutylene ethylene diamine and a minor amount of polyisobutylene. These subcomponents will usually be employed in admixture with a hydrocarbon solvent to facilitate addition of Component (II) to a base motor fuel composition.

The polyisobutylene ethylene diamine subcomponent of Component (II) of the instant invention is typically present in a concentration range of 50–75 parts, preferably about 60 parts by weight, based upon the weight of the entire composition which makes up Component (II). The polyisobutylene ethylene diamine subcomponent is of the formula

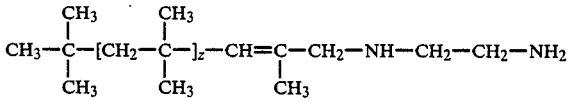

where z has a value of 30–40, preferably 32–35, most preferably 33.

The polyisobutylene subcomponent of Component (II) of the instant invention is typically present in a concentration range of 5–25 parts, preferably 10–20 parts by weight, based upon the weight of the entire composition which makes up Component (II). The polyisobutylene subcomponent is of the formula

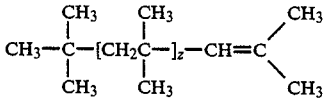

where z again has a value of 30–40, preferably 32–35, most preferably 33.

The hydrocarbon solvent employed to facilitate admixture of the abovedescribed subcomponents is preferably a light aromatic distillate composition. A commercially available light aromatic distillate composition containing the abovedescribed polyisobutylene ethylene diamine and polyisobutylene compounds in the abovespecified concentrations and particularly preferred for use as Component (II) of the instant invention is the commercial gasoline additive ORONITE OGA-472, available from Chevron Chemical Company, ORONITE OGA-472 is a composition containing approximately 60 parts by weight of polyisobutylene ethylene diamine, approximately 13 parts by weight polyisobutylene, and approximately 27 parts by weight light aromatic distillate, including xylene and $C_9$ alkylbenzenes. Fuel compositions containing ORONITE OGA-472 as an additive include those described in U.S. Pat. Nos. 4,141,593 (Feldman et al.), 4,028,065 (Sprague et al.), and 3,966,429 (Sprague et al.).

The motor fuel composition of the instant invention comprises a major amount of a base motor fuel and 0.0005–5.0 weight percent, preferably 0.001–1.0 weight percent of Component (I) (the abovedescribed reaction product component) and 0.001–1.0 weight percent, preferably 0.01–0.5 weight percent of Component (II), (the abovedescribed mixture comprising a major amount of polyisobutylene ethylene diamine and a minor amount of polyisobutylene in a hydrocarbon solvent). Preferred base motor fuel compositions are those intended for use in spark ignition internal combustion engines. Such motor fuel compositions, generally referred to as gasoline base stocks, preferably comprise a mixture of hydrocarbons boiling in the gasoline boiling range, preferably from about 90° F. to about 450° F. This base fuel may consist of straight chains or branched chains or paraffins, cycloparaffins, olefins, aromatic hydrocarbons, or mixtures thereof. The base fuel can be derived from, among others, straight run naphtha, polymer gasoline, natural gasoline, or from catalytically cracked or thermally cracked hydrocarbons and catalytically reformed stock. The composition and octane level of the base fuel are not critical and any conventional motor fuel base can be employed in the practice of this invention. In addition, the motor fuel composition may contain any of the additives generally employed in gasoline. Thus, the fuel composition can contain conventional carburetor detergents, anti-knock compounds such as tetraethyl lead compounds, anti-icing additives, upper cylinder lubricating oils, and the like. A motor fuel composition representing the best mode of practicing the instant invention is set forth in Example IV, below.

EXAMPLE IV

In the best mode of practicing the instant invention, 30 PTB of the reaction product set forth in Example I (i.e. 30 pounds of reaction product per 1000 barrels of gasoline equivalent to about 0.01 weight percent of reaction product component based on the weight of the fuel composition) and 205 PTB (about 0.07 weight percent) of a composition (ORONITE OGA-472) containing approximately 60 parts by weight polyisobutylene ethylene diamine, approximately 13 parts by weight polyisobutylene, and approximately 27 parts by weight light aromatic distillate comprising xylene and $C_9$ alkylbenzenes were added to a major amount of a base motor fuel composition which comprises a mixture of hydrocarbons boiling in the range of about 90° F.–450° F.

It has been found that a motor fuel composition containing 0.0005–5.0 weight percent, preferably 0.001–1.0 weight percent of Component (I) and 0.001–1.0 weight percent, preferably 0.01–0.5 weight percent of Component (II) is effective in both minimizing and reducing the ORI of a gasoline internal combustion engine, and in improving carburetor detergency and intake valve cleanliness of the motor fuel. These improvements have been demonstrated in ORI and carburetor detergency tests where the performance characteristics of a base motor fuel composition containing a commercial fuel additive and an improved motor fuel composition of the instant invention were compared.

The base motor fuel employed in the tests (herein designated as Base Fuel A) was a premium grade gasoline essentially unleaded (less than 0.05 g of tetraethyl lead per gallon), and comprised a mixture of hydrocarbons boiling in the gasoline boiling range consisting of about 22% aromatic hydrocarbons, 11% olefinic carbons, and 67% paraffinic hydrocarbons, boiling in the range from about 90° F. to 450° F. In preparing motor fuels for the ORI and carburetor, intake valve and manifold detergency tests, a suitable amount of the reaction product component of the instant invention was added directly to Base Fuel A without additional solvents being necessary. As previously stated, the gasoline solubility of the reaction product component of the instant invention is attributed to the presence of a large number of polyoxypropylene ether moieties in combination with polyoxyethylene and polyoxybutylene ether moieties.

The ORI tendencies of Base Fuel A containing 60 PTB of a commercial fuel additive (60 pounds of reaction product per 1000 barrels of gasoline, equivalent to about 0.02 weight percent of reaction product based on the weight of the fuel composition), as well as a motor fuel composition of the instant invention, as exemplified by Example IV, were measured via the Fuel Related Deposit Test (FRDT). The test measures the octane requirement of an engine for a particular motor fuel as a function of varying engine speed and load. This test employs a 1.8 liter Chevrolet engine controlled by a dedicated computer which operates the engine speed and load controls, test stand safeties, and data acquisition. Due to the multifunctional capabilities of the computer controlled system, the test cycle very closely simulates an actual engine in a vehicle. The computer can change the engine speed and load quickly and often, and therefore provides a good simulation of a vehicle driving in an urban environment.

The experimental results obtained from the FRDT for Base Fuel A containing 60 PTB of commercial fuel additive and a motor fuel composition of the instant invention (Example IV) are set forth in FIG. 1. As illustrated by FIG. 1, the octane requirement of the engine using Base Fuel A containing 60 PTB of commercial fuel additive was consistently higher than the corresponding octane requirement of the engine using a motor fuel composition of the instant invention over the duration of the test. The one exception to this was the engine octane requirement results obtained for Run #2, where the octane requirement of Base Fuel A containing 60 PTB of commercial additive significantly decreased between 150 and 200 hours of engine operation (see FIG. 1). However, this unusual result was due to engine ignition problems in Run #2, and does not detract from the superiority of the instant invention over a motor fuel containing a commercial fuel additive. The data set forth in FIG. 1 thus indicate that a motor fuel composition of the instant invention has reduced ORI tendencies in comparison with a typical commercially available motor fuel composition.

The carburetor intake valve and intake manifold detergency properties of a commercially available motor fuel and a motor fuel composition of the instant invention (Example IV) were also measured via the Merit Rating Test. This test may be described as follows. At the end of a FRDT run for a given motor fuel composition, portions of the engine are disassembled and various engine components are visually examined to determine the extent of deposit formation. This is determined via a visual rating system scaled from 1–10, with a value of 10 being a clean component and a value of 1 being a deposit-laden component.

The experimental results obtained from the Merit Rating Test are set forth in Table I. As illustrated by Table I, a motor fuel composition of the instant invention is approximately as effective (based upon merit ratings) as a commercially available fuel. In addition, a motor fuel composition of the instant invention shows improved valve deposit control, in view of both valve merit rating and reduced valve deposit weight.

TABLE I

Chevy 1.8 liter Engine (FRDT) Merit Rating Results

| | Commerical Fuel | Instant Invention (Example IV) |
|---|---|---|
| Duration of Test Run (hours) | 150 | 150 |
| Merit Ratings:* | | |
| Body | 7.8 | 9.1 |
| Primary | 9.8 | 9.5 |
| Secondary | 5.8 | 8.7 |
| Plate | 8.4 | 8.2 |
| Primary | 9.8 | 8.4 |
| Secondary | 7.0 | 7.9 |
| Man Runner | 8.6 | 9.2 |
| Head Runner | 7.6 | 8.6 |
| Head Ports | 6.2 | 7.6 |
| Valves | 4.6 | 6.8 |
| Valve Deposit Wt. (Mg) | 1.8 | 0.5 |
| Combustion Chamber | 7.8 | 7.5 |
| Piston | 8.0 | 7.5 |

*Merit Rating of 10 = clean (no deposits)

The ORI tendencies of a commercial available gasoline and a motor fuel composition of the instant invention were also measured via the 2.0 liter Chevrolet (Throttle Body Injector) multicylinder engine test (Chevy Test). The Chevy Test employs a 2.0 liter Chevrolet in-line four cylinder engine with a cast alloy iron cylinder head having separate intake and exhaust ports for each cylinder. An electronically controlled fuel injection system maintains the required fuel flow to each engine cylinder by monitoring various engine operating parameters (e.g. manifold absolute pressure, throttle valve position, coolant temperature, engine r.p.m, and exhaust gas oxygen content) and adjusting the fuel flow accordingly. The fuel system supplying fuel to the engine is specifically adapted for the determination of engine ORI. At the beginning of the engine rating procedure, a fuel with an octane rating high enough to ensure that no audible engine knock is present is employed. The next lower octane fuel is then switched with the previous fuel, and this procedure continues until a knock becomes audible. The octane level one number above knock is the engine octane requirement. Engine ORI was determined as a function of hours of engine operation for both the commercial gasoline and a motor fuel composition of the instant invention.

Figure 2:
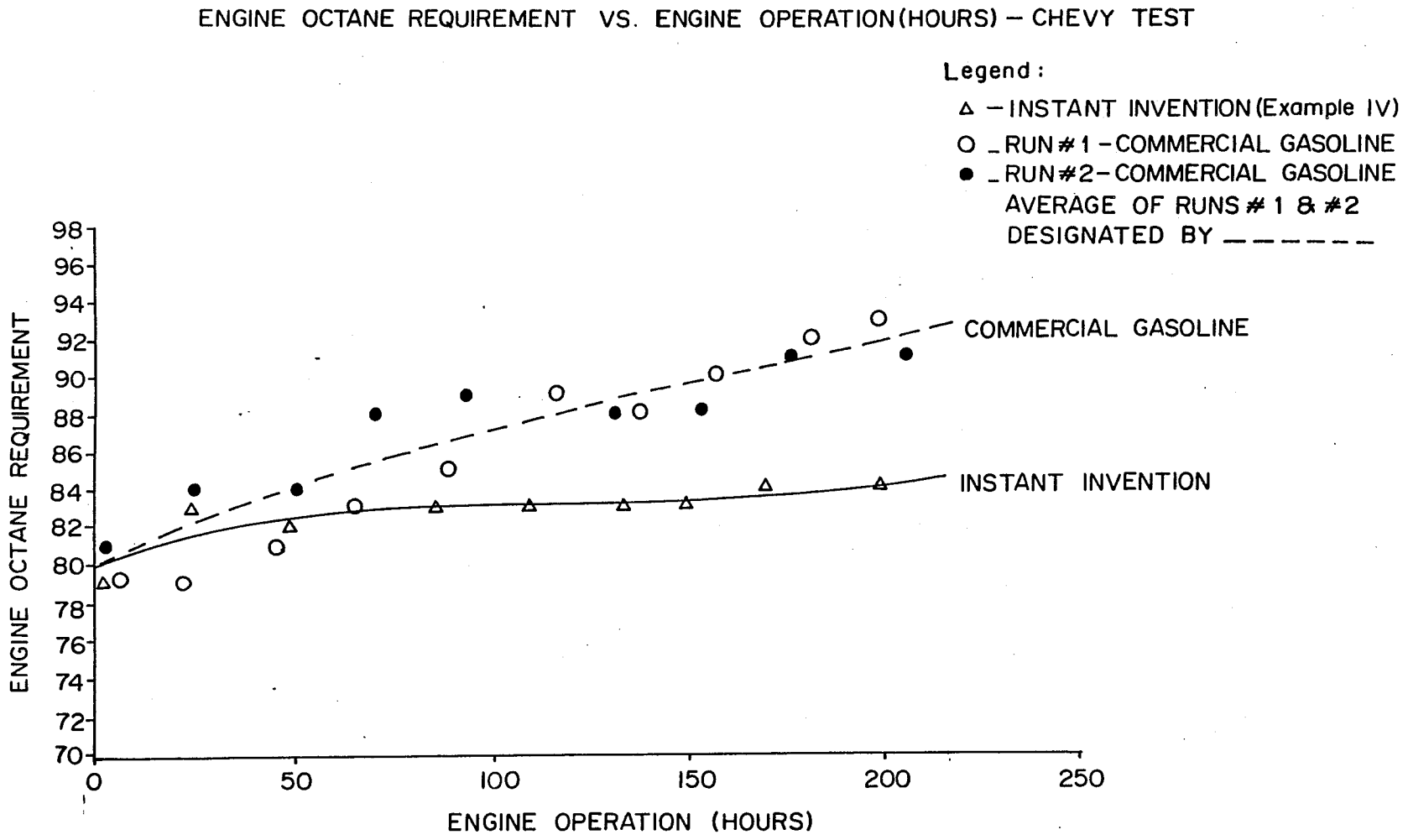
FIG. 2 is a graphical representation of data obtained which compares the octane requirement (as a function of hours of engine operation) of a Chevrolet 2.0 liter engine using a commercial gasoline, and the identical engine using a motor fuel composition of the instant invention as exemplified by Example IV.

As illustrated by FIG. 2, the octane requirement of the engine using the commercial gasoline was consistently higher than the corresponding octane requirement of the engine using a motor fuel composition of the instant invention over the duration of the test. After about 200 hours of engine operation in the Chevy Test, the commercial gasoline gave an ORI number approximately 5–7 units higher than the instant invention. The data set forth in FIG. 2 thus again indicate that a motor fuel composition of the instant invention has reduced ORI tendencies in comparison with a typical commercially available gasoline.

The carburetor, intake valve and intake manifold detergency properties of the commercial gasoline and a motor fuel composition of the instant invention (Example IV) were also compared via the Merit Rating Test. AT the end of a Chevy Test run for a given motor fuel composition, portions of the engine are disassembled and various engine components are visually examined to determine the extent of deposit formation. This is determined via a visual rating system scaled from 1-10, with a value of 10 being a clean component and a value of 1 being a deposit-laden component.

The experimental results obtained from the abovedescribed Merit Rating Test are set forth in Table II. As illustrated by Table II, a motor fuel composition of the instant invention was approximately as effective (based upon merit ratings) as a commercially available gasoline. In addition, a motor fuel composition of the instant invention showed improved valve deposit control, both in terms of valve merit rating and reduced valve deposit weight.

TABLE II

Chevy 2.0 liter Engine (Chevy Test) Merit Rating Results

| | Commercial Gasoline | Instant Invention (Example IV) |
|---|---|---|
| Duration of Test Run (hours) | 207 | 200 |
| Merit Ratings:* | | |
| Body | 10.0 | 8.9 |
| Plate | 9.8 | 9.3 |
| Manifold Runner | 8.8 | 9.5 |
| Head Runner | 8.5 | 7.9 |
| Head Parts | 5.2 | 8.0 |
| Valves | 5.0 | 8.2 |
| Valve Deposit Wt. (Mg) | 1.9 | 0.3 |
| Combustion Chamber | 8.5 | 7.8 |
| Piston Crown | 8.4 | 8.0 |

*Merit Rating of 10 = clean (no deposits)

For convenience in shipping and handling, it is useful to prepare a concentrate of the reaction product and polyisobutylene ethylene diamine-polyisobutylene components of the instant invention. The concentrate may be prepared in a suitable liquid solvent such as toluene and xylene, with xylene being preferred. In the best mode of preparing a concentrate of the instant invention, approximately 0.1-10.0, preferably 5.0-10.0 percent of the reaction product of Example I, and approximately 25.0-75.0, preferably 50.0-60.0 weight percent of the abovedescribed aromatic distillate-polyisobutylene ethylene diamine-polyisobutylene mixture are employed in admixture with 25.0-50.0, preferably 30.0-40.0 weight percent of aromatic hydrocarbons, preferably xylene. All weight percents are based upon the total weight of the concentrate.

It will be evident that the terms and expressions employed herein are used as terms of description and not of limitation. There is not intention, in the use of these descriptive terms and expressions, of excluding equivalents of the features described and it is recognized that various modifications are possible within the scope of the invention claimed.

The invention claimed is:

1. A motor fuel composition comprising a mixture of hydrocarbons boiling in the range from about 90° F.-450° F. and additionally comprising:

(I) from 0.0005-5.0 weight percent of the reaction product obtained by reacting a temperature of 30° C.-200° C.:

(a) about 1 mole of a dibasic acid anhydride of the formula

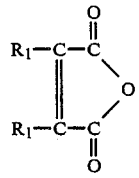

where $R_1$ is H or a $C_1$-$C_5$ alkyl radical, (b) 1-2 moles of a polyoxyalkylene diamine of the formula

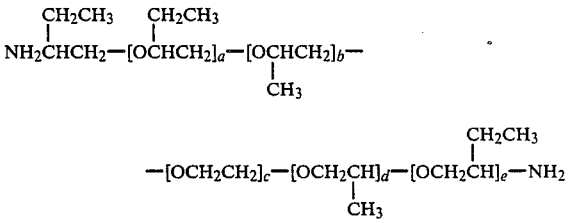

where c has a value from about 5-150, b+d has a value from about 5-150, and a+e has a value from about 2-12, and (c) 1-2 moles of a hydrocarbyl polyamine which may be either (i) a hydrocarbyl polyamine of the formula $R_2(NH—R_3)_x—NH_2$ where $R_2$ is an alkyl radical having from about 1-24 carbon atoms, $R_3$ is an alkylene radical having from about 1-6 carbon atoms, and x has a value from about 1-10, or (ii) a n-alkyl-alkylene diamine of the formula $R_4—NH—(CH_2)_n—NH_2$ where $R_4$ is an aliphatic hydrocarbon radical having from about 1-24 carbon atoms and n has a value from about 1-6; and (II) from 0.001-1.0 weight percent of a mixture comprising a hydrocarbon solvent and:

(a) 50-75 parts by weight of polyisobutylene ethylene diamine of the formula

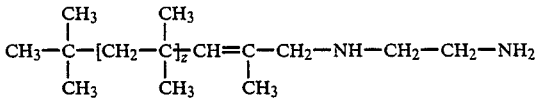

and (b) 5-25 parts by weight of polyisobutylene of the formula

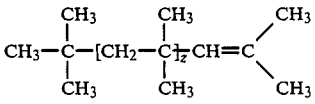

where z has a value of 30-40.

2. A motor fuel composition according to claim 1, in which said reaction product component is obtained by reacting about 1 mole of said dibasic acid anhydride with about 1.5 moles of said polyoxyalkylene diamine and about 1 mole of said hydrocarbyl polyamine.

3. A motor fuel composition according to claim 1, where said dibasic acid anhydride reactant is maleic anhydride.

4. A motor fuel composition according to claim 1, where said polyoxyalkylene diamine reactant is of the formula

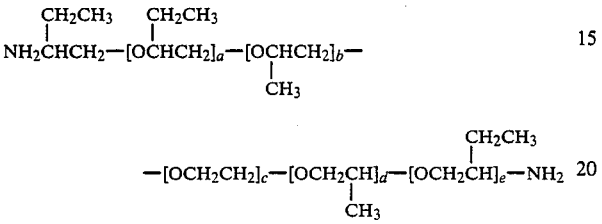

and c has a value from about 8–50, b+d has a value from about 8–50, and a+e has a value from about 4–8.

5. A motor fuel composition according to claim 1, where said hydrocarbyl polyamine reactant is either:

(i) a hydrocarbyl polyamine of the formula $$R_2(NH—R_3)_x—NH_2$$

where $R_2$ is an alkyl radical having from about 12–20 carbon atoms, $R_3$ is an alkylene radical having from about 1–6 carbon atoms, and x has a value from 1–5; or (ii) a n-alkyl-alkylene diamine of the formula $$R_4—NH—(CH_2)_n—NH_2$$

where $R_4$ is an aliphatic hydrocarbon radical having from about 12–20 carbon atoms, and n has a value of 3.

6. A motor fuel composition according to claim 5, where said n-alkyl-alkylene diamine reactant is selected from the group consisting of:

n-coco-1,3-diaminopropane;
n-soya-1,3-diaminopropane;
n-tallow-1,3-diaminopropane; and
n-oleyl-1,3-diaminopropane.

7. A motor fuel composition according to claim 6, where said n-alkyl-alkylene diamine reactant is n-tallow-1,3 diaminopropane.

8. A motor fuel composition according to claim 1, where z has a value of 32–35.

9. A motor fuel composition according to claim 1, where said hydrocarbon solvent is an aromatic distillate comprising xylene and $C_9$ alkylbenzene compounds.

10. A motor fuel composition comprising a mixture of hydrocarbons boiling in the range from about 90° F.-450° F., and additionally comprising:

(I) from about 0.001–1.0 weight percent of the reaction product obtained by reacting, at a temperature of 90° C.–150° C.:

(a) about 1 mole of maleic anhydride, (b) about 1.5 moles of a polyoxyalkylene diamine of the formula

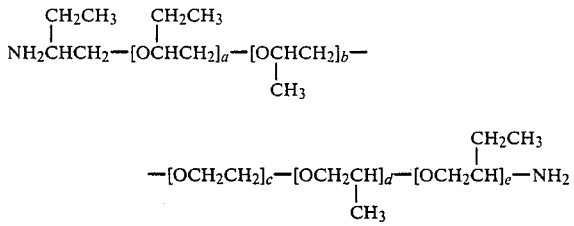

where c has a value from about 8–50, b+d has a value from about 8–50, and a+e has a value from about 4–8, and (c) about 1 mole of the n-alkyl-alkylene diamine n-tallow-1,3-diaminopropane; and (II) from about 0.01–0.5 weight percent of a mixture comprising an aromatic distillate and:

(a) about 60 parts by weight of polyisobutylene ethylene diamine of the formula

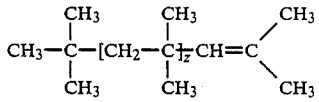

and (b) about 10–20 parts by weight of polyisobutylene of the formula

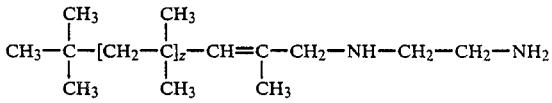

where z has a value of 32–35.

11. A concentrate composition comprising a hydrocarbon solvent in admixture with:

(I) from 0.1–10.0 weight percent of the reaction product obtained by reacting a temperature of 30° C.–200° C.:

(a) about 1 mole of a dibasic acid anhydride of the formula

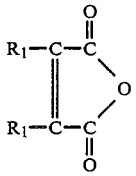

where $R_1$ is H or a $C_1$-$C_5$ alkyl radical, (b) 1–2 moles of a polyoxyalkylene diamine of the formula

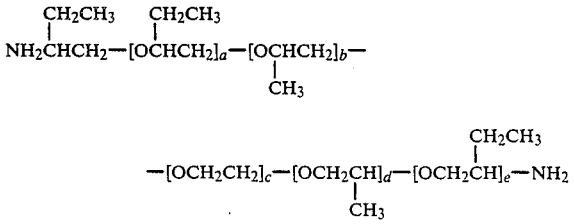

where c has a value from about 5–150, b+d has a value from about 5–150, and a+e has a value from about 2–12, and (c) 1–2 moles of a hydrocarbyl polyamine which may be either (i) a hydrocarbyl polyamine of the formula $$R_2(NH—R_3)_x—NH_2$$

where $R_2$ is an alkyl radical having from about 1–24 carbon atoms, $R_3$ is an alkylene radical having from about 1–6 carbon atoms, and x has a value from about 1–10, or (ii) a n-alkyl-alkylene diamine of the formula $$R_4—NH—(CH_2)_n—NH_2$$

where $R_4$ is an aliphatic hydrocarbon radical having from about 1–24 carbon atoms and n has a value from about 1–6; and (II) from 25.0–75.0 weight percent of a mixture comprising a hydrocarbon solvent and:

(a) 50–75 parts by weight of polyisobutylene ethylene diamine of the formula

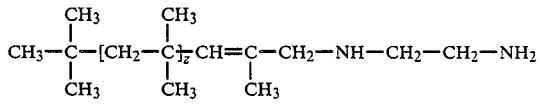

and (b) 5–25 parts by weight of polyisobutylene of the formula

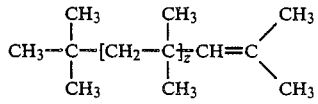

where z has a value of 30–40.

* * * * *

UNITED STATES PATENT AND TRADEMARK OFFICE

CERTIFICATE OF CORRECTION

PATENT NO. : 4,852,993

DATED : Aug. 1, 1989

INVENTOR(S) : Rodney L. Sung, et al.

It is certified that error appears in the above—identified patent and that said Letters Patent is hereby corrected as shown below:

Col. 16, line 22,

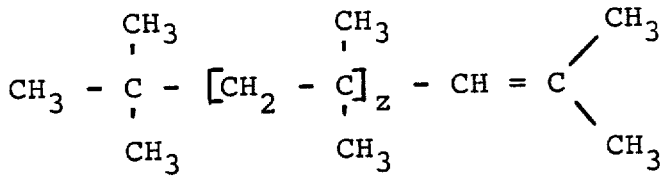

should read --

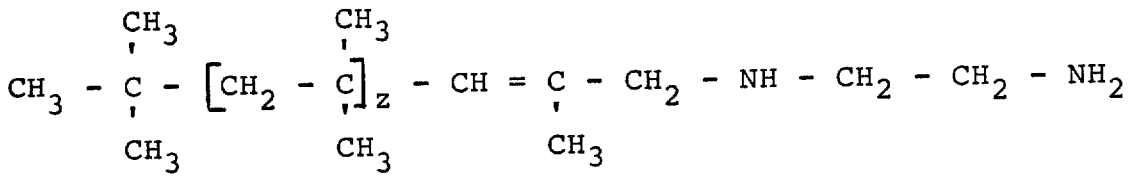

--;

UNITED STATES PATENT AND TRADEMARK OFFICE

CERTIFICATE OF CORRECTION

PATENT NO. : 4,852,993

DATED : Aug. 1, 1989

INVENTOR(S) : Rodney L. Sung, et al.

It is certified that error appears in the above—identified patent and that said Letters Patent is hereby corrected as shown below:

Col. 16, line 32,

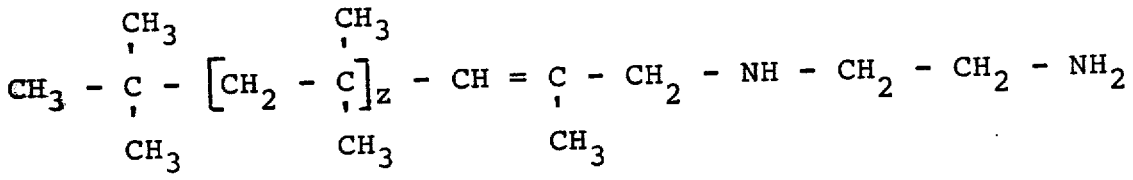

should read --

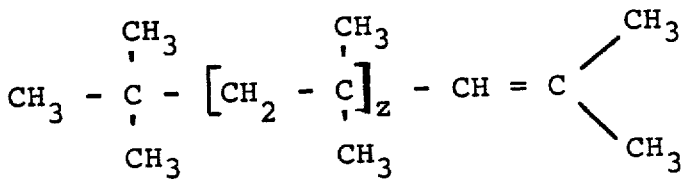

--.

Signed and Sealed this

Eighteenth Day of December, 1990

*Attest:*

HARRY F. MANBECK, JR.

*Attesting Officer*

*Commissioner of Patents and Trademarks*